US008077047B2

(12) United States Patent
Humble et al.

(10) Patent No.: US 8,077,047 B2
(45) Date of Patent: Dec. 13, 2011

(54) TAMPERING DETECTION SYSTEM USING QUANTUM-MECHANICAL SYSTEMS

(75) Inventors: Travis S. Humble, Knoxville, TN (US); Ryan S. Bennink, Knoxville, TN (US); Warren P. Grice, Oak Ridge, TN (US)

(73) Assignee: Ut-Battelle, LLC, Oak Ridge, TN (US)

( * ) Notice: Subject to any disclaimer, the term of this patent is extended or adjusted under 35 U.S.C. 154(b) by 371 days.

(21) Appl. No.: 12/424,957

(22) Filed: Apr. 16, 2009

(65) Prior Publication Data

US 2010/0265077 A1 Oct. 21, 2010

(51) Int. Cl.
*G08B 17/12* (2006.01)

(52) U.S. Cl. ..... 340/600; 340/552; 340/564; 340/565; 356/450

(58) Field of Classification Search ..... 340/600, 340/552, 551, 555–557, 564, 565; 356/450, 356/484

See application file for complete search history.

(56) References Cited

U.S. PATENT DOCUMENTS 4,899,043 A * 2/1990 Mochizuki et al. ..... 356/432
7,075,438 B2 * 7/2006 Kent et al. ..... 340/572.1
7,483,142 B2 1/2009 Kent et al.
7,701,381 B2 * 4/2010 Schmitt et al. ..... 342/42

* cited by examiner

*Primary Examiner* — Anh V La
(74) *Attorney, Agent, or Firm* — Luedeka, Neely & Graham, P.C.

(57) ABSTRACT

The use of quantum-mechanically entangled photons for monitoring the integrity of a physical border or a communication link is described. The no-cloning principle of quantum information science is used as protection against an intruder's ability to spoof a sensor receiver using a 'classical' intercept-resend attack. Correlated measurement outcomes from polarization-entangled photons are used to protect against quantum intercept-resend attacks, i.e., attacks using quantum teleportation.

21 Claims, 5 Drawing Sheets

TAMPERING DETECTION SYSTEM USING QUANTUM-MECHANICAL SYSTEMS

GOVERNMENT RIGHTS

This invention was made with government support under Contract No. DE-AC05-00OR22725 awarded by the U.S. Department of Energy. The government has certain rights in the invention.

FIELD

This disclosure relates to the field of security systems. More particularly, this disclosure relates to detection of tampering with security systems.

BACKGROUND

Many government, industrial, and commercial entities have a need to protect various aspects of their endeavors from hostile physical intrusion. Such intrusions may range from terrorist attacks to burglary attempts to mischievous mayhem to industrial or military espionage. To prevent such actions it is often desirable to secure the property boundaries at sensitive sites such as nuclear and chemical facilities, military bases, and other sensitive installations. Sometimes such protection focuses on a boundary of a particular facility such as a warehouse, a vault, a storage crib, or a similar protected zone. In some instances a security system may be employed to monitor a physical boundary associated with such a system. For example, a fence around a protected property may include an electronic continuity circuit that is designed to detect a break in the fence that could indicate an intrusion into the property. In some instances a security system may be employed to monitor the physical integrity of a secured space. Examples of such security systems are window and door alarms, motion detectors, and optical beam interruption detectors. Also, distribution systems such as gas and oil pipelines, electrical distribution systems, and voice and data communication lines often warrant special security measures. In the case of pipelines, fluid pressure monitors may be used to detection intrusion of the boundary (i.e., the path) of a pipeline. In the case of electrical power distribution systems and communication systems, the detection of service interruption may be used to detect tampering with the "boundary" (i.e., the distribution/communication lines) associated with such systems. However in the case of communication lines it is often necessary to also protect against eavesdropping, and various detection systems have been developed for that purpose. However adversary nations, terrorists, rogue organizations, and thieves are becoming increasingly technically sophisticated in their abilities to attack and thwart such security measures. What are needed therefore are improved security systems for protecting various boundaries and communication lines from compromise by such attacks.

SUMMARY

In one embodiment the present disclosure provides a system for monitoring the integrity of a boundary. The system includes a source apparatus for generating a first and a second quantum system, where the first and the second quantum systems are quantum mechanically entangled in at least one monitored physical property. There is a transmission medium disposed along the boundary. A first receiver and a second receiver are provided. There is a transmission apparatus that is provided for directing the first quantum system through the transmission medium to the first receiver and for directing the second quantum system to the second receiver. There is an evaluation apparatus that is provided for assessing a first verifying quantum system received by the first receiver and for assessing a second verifying quantum system received by the second receiver. The evaluation apparatus also estimates whether the first verifying quantum system and the second verifying quantum system are quantum mechanically entangled in the at least one monitored physical property. Further provided is an alarm apparatus for indicating a possible compromise of the boundary if the first verifying quantum system and the second verifying quantum system are not likely quantum mechanically entangled in the at least one monitored physical property.

A further embodiment provides a system for monitoring the integrity of a communication link. The system includes a source apparatus for generating a first and a second quantum system, where the first and the second quantum systems are quantum mechanically entangled in at least one monitored physical property, and where each monitored physical property has a value pair corresponding to the first and the second quantum system. There is a first receiver and a second receiver that are operatively connected by the communication link. A transmission apparatus is provided for directing the first quantum system through the communication link to the first receiver and for directing the second quantum system to the second receiver. There is a first evaluation apparatus for estimating a first value of each monitored physical property of a first verifying quantum system received by the first receiver, and there is a second evaluation apparatus for estimating a second value of each monitored physical property of a second verifying quantum system received by the second receiver. An alarm system is provided for indicating a possible compromise of the communication link if the estimated first value of each monitored physical property of the first verifying quantum system and the estimated second value of each monitored physical property of the second verifying quantum system are not likely equal to the value of each monitored physical property.

Another embodiment provides a system for monitoring the integrity of a transmission of a quantum system. This embodiment includes an apparatus for generating the quantum system with an as-transmitted value of a monitored physical property. A transmission medium is provided as is a receiver and a transmission apparatus for directing the quantum system through the transmission medium to the receiver. There is an evaluation system for estimating an as-received value of the monitored physical property of a verifying quantum system received by the receiver, and an alarm system for comparing the as-transmitted value of the monitored physical property of the transmitted quantum system with the as-received value of the monitored physical property of the verifying quantum system. The alarm system indicates a possible compromise of the transmission of the quantum system if the estimated as-received value of the monitored physical property of the verifying quantum system does not likely correspond to the as-transmitted value of the monitored physical property of the transmitted quantum system.

A method is provided for monitoring the integrity of a boundary. The method includes a step of generating a first and a second quantum system, where the first and the second quantum systems are quantum mechanically entangled in at least one monitored physical property. A further step includes transmitting the first quantum system through a transmission medium along the boundary to a first receiver and transmitting the second quantum system to a second receiver. Another step is estimating whether the first verifying quantum system received by the first receiver and the second verifying quantum system received by the second receiver are quantum mechanically entangled in the at least one monitored physical property. The method also provides for generating an indication of possible compromise of the boundary if the first verifying quantum system and the second verifying quantum system are not likely quantum mechanically entangled in the at least one monitored physical property.

A further method embodiment is a method for monitoring the integrity of a communication link. This embodiment includes a step of generating a first and a second quantum system, where the first and the second quantum systems are quantum mechanically entangled in at least one monitored physical property, with each monitored physical property having a value pair corresponding to the first and the second quantum system. A further step is transmitting the first quantum system through the communication link to a first receiver and transmitting the second quantum system to a second receiver. Two additional steps are estimating a first value of each monitored physical property of a first verifying quantum system received by the first receiver, and estimating a second value of each monitored physical property of a second verifying quantum system received by the second receiver. The method further provides for comparing the estimated first value of each monitored physical property of the first verifying quantum system with the estimated second value of each monitored physical property of the second verifying quantum system. A further step is generating an indication of a possible compromise of the communication link if the estimated first value of each monitored physical property of the first verifying quantum system and the estimated second value of each monitored physical property of the second verifying quantum system are not likely equal to the value pair of each monitored physical property.

A further method embodiment is provided for monitoring the integrity of a transmission of a quantum system. This embodiment includes the steps of generating the quantum system with an as-transmitted value of a monitored physical property, transmitting the quantum system through a transmission medium to a receiver, and estimating an as-received value of the monitored physical property of a verifying quantum system received by the receiver. A further step is comparing the as-transmitted value of the monitored physical property of the transmitted quantum system with the estimated as-received value of the monitored physical property of the verifying quantum system. Also provided in this embodiment is a step of indicating a possible compromise of the transmission of the quantum system if the estimated as-received value of the monitored physical property of the verifying quantum system does not likely correspond to the as-transmitted value of the monitored physical property of the transmitted quantum system.

Further provided is a method for verifying the integrity of a physical perimeter. This embodiment includes the steps of generating an entangled pair of first and second quantum systems, directing the first quantum system about the physical perimeter, and comparing the first quantum system with the second quantum system for verification of the authenticity of the first quantum system.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
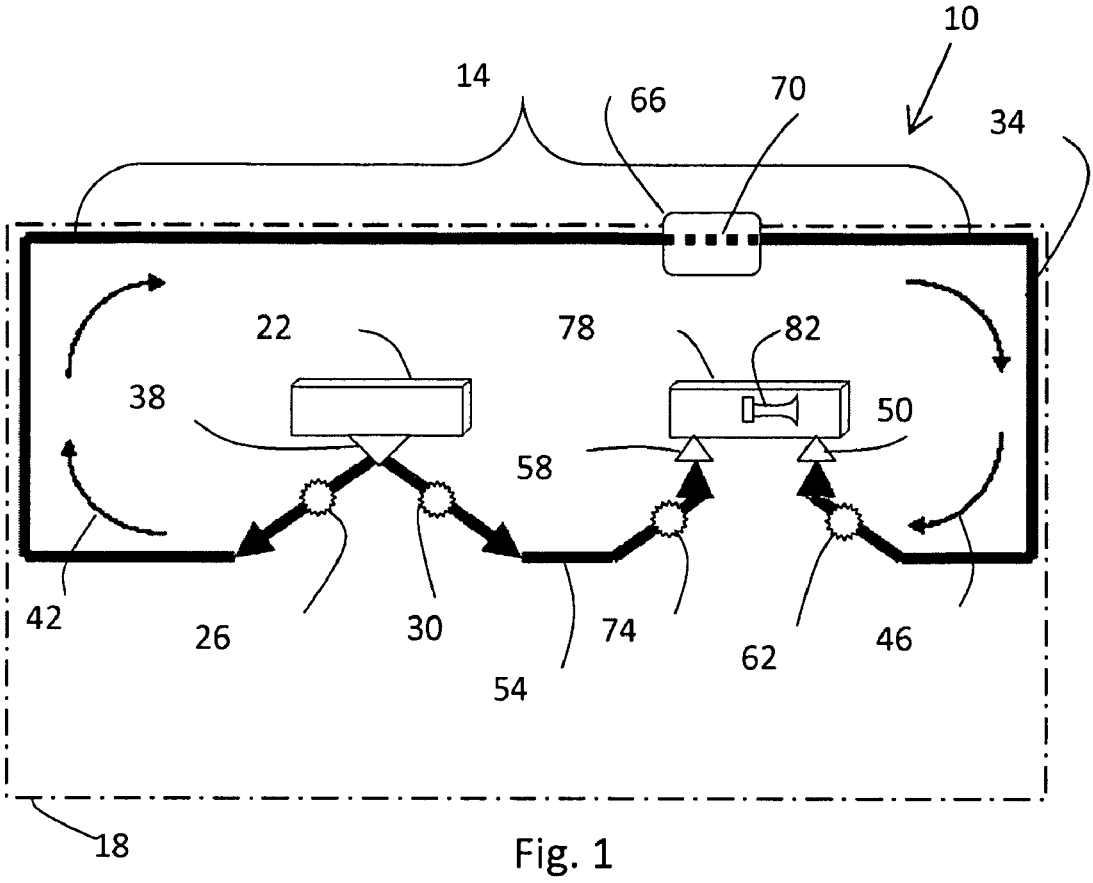
FIG. 1 is a somewhat schematic view of a system for monitoring the integrity of a boundary.

In the following detailed description of the preferred embodiments, reference is made to the accompanying drawings, which form a part hereof, and within which are shown by way of illustration the practice of specific embodiments of systems and methods for monitoring the integrity of boundaries, communications links and transmission of quantum systems. It is to be understood that other embodiments may be utilized, and that structural changes may be made and processes may vary in other embodiments.

There are many government, industrial, commercial, institutional, and personal situations where it is desirable to maintain the integrity of a boundary. The term "boundary" as used herein refers to a spatial demarcation that separates a region in which some level of protection is intended from a region in which a lesser level or no level of protection is intended. Examples of a boundary are a fence line of a military base, a tool crib, a school yard, and a door of a home. The interruption of a beam of light is commonly used to detect the passage of a person or object across a boundary, and thereby indicate a potential compromise of the integrity of a boundary. For example, a visible or invisible "laser tripwire" functions by transmitting light along a boundary to a remote receiver. When the beam of light is blocked, its absence at the receiver signals an alarm. This sensing strategy is vulnerable, however, to an intercept-resend attack, i.e., an attack in which an intruder intercepts the incoming beam of light, accurately records its properties (to arbitrary precision), and resends a perfect duplicate to the receiver. A similar vulnerability arises with classical electronic surveillance systems such as closed-circuit TV, burglar alarms, and tamper-indicators. This vulnerability arises in the context of a classical physical system because an intruder has an opportunity to reliably intercept and measure classical information describing the transmitted signal and to reproduce the signal and send the reproduced signal to the receiver, leaving a physical gap in the protection of the boundary.

The ability to copy, or clone, information is a vulnerability that is inherent with classical physical boundary systems. This vulnerability, however, does not exist within the context of quantum mechanics systems. Quantum mechanics is a set of principles underlying the most fundamental known properties of all physical systems. Notable among these principles are both a dual wave-like and particle-like behavior of matter and radiation. More specifically and pertinent to this disclosure, a generally-accepted "no-cloning" theorem states that an arbitrary quantum of information, e.g., an unknown qubit, cannot be reliably cloned due to fundamental restrictions imposed on measurement by the linearity of quantum mechanics. This characteristic provides an entanglement-based alternative to the transmission of classical information across a physical boundary, and depending on the embodiment implemented, substantially all or at least a large portion of the vulnerability to an intercept-resend attack is negated.

FIG. 1 illustrates an example of a system 10 for monitoring the integrity of a boundary using quantum mechanically entangled systems. The system 10 is configured to protect a boundary 14 portion of a perimeter 18 of a physical space. In some embodiments the system 10 may be configured to protect the entire perimeter 18.

The system 10 of FIG. 1 has a source apparatus 22 that generates a first 26 and a second 30 quantum system. In the embodiment of FIG. 1 the source apparatus 22 is a spontaneous parametric down conversion (SPDC) photon pair generator, and the first 26 and the second 30 quantum systems are quantum mechanically entangled photons. Quantum entanglement is a possible configuration of two quantum mechanical systems that are linked together so that at least one physical characteristic of one system is inextricably conditioned by a corresponding physical condition of the second system, even though the individual systems may be spatially separated. Ideally, when the first 26 and the second 30 quantum systems are photons, each quantum system is a single true photon. However, the first 26 and the second 30 quantum systems may acceptably be approximations of a single photon (or single pair) state.

In the embodiment of FIG. 1 the first 26 and the second 30 quantum physical systems have quantum mechanically entangled polarizations. In other embodiments the first 26 and the second 30 quantum systems may be photons having quantum entangled frequencies, or may be photons having both quantum entangled polarizations and quantum entangled frequencies. In other embodiments the first 26 and the second 30 quantum systems may be entangled semiconductor quantum dots instead of entangled photons.

In the embodiment of FIG. 1 there is a transmission medium 34 that is disposed adjacent the boundary 14. In the embodiment of FIG. 1 the transmission medium 34 is a fiber optic cable and photons are beamed through the fiber optic cable. In other embodiments the transmission medium 34 may be the atmosphere and photons are beamed through the atmosphere. The "atmosphere," as the term is used here, encompasses any translucent environment including the vacuum of outer space and the waters of the world. In embodiments where the first quantum system 26 and the second quantum system 30 are entangled semiconductor quantum dots the transmission medium 34 may be an electrical conductor.

Typically the transmission medium 34 is physically integrated with the boundary 14. For example, if the boundary 14 includes a fence, the transmission medium 34 (which in the example of FIG. 1 is a fiber optic cable) may be woven into the fence. Consequently a compromise of the transmission medium 34, such as a break in the fiber optic cable, is indicative of a loss of integrity of the boundary. If the atmosphere is the transmission medium then the photon transmission beam passes through the atmosphere along the border and the transmission medium is typically breached by a blockage of the photon beam by a physical object, which is indicative of a loss of integrity of the boundary. The type of actions that may result in a malevolent compromise of the transmission medium depends upon the nature of the physical area being protected. For example if the protected area is a military installation, the loss of integrity of the boundary may be the result of an intrusion by an armed force. If the protected area is a prison the loss of integrity of the boundary may be the result of a prisoner escape. If the protected area is an information processing system the loss of integrity of the boundary may be the result of an attempt to electronically or visually acquire information from the information processing system.

Returning to the details of FIG. 1, the source apparatus 22 is constructed in a cross-ringed photon emission configuration. A transmission apparatus 38 is provided and the transmission apparatus 38 comprises an optical coupling device that receives the first 26 and the second 30 quantum systems from the intersections of the crossed rings produced by the source apparatus 22. The transmission apparatus 38 directs the first quantum system 26 in the directions 42 and 46 through the transmission medium 34 to a first receiver 50, and directs the second quantum system 30 through a reliable path 54 to a second receiver 58.

Under normal operations where there has been no compromise of the transmission medium 34, the first receiver 50 receives a first verifying quantum system 62, which is the first quantum system 26. However if the transmission medium 34 has been compromised by, for example, a breach of the boundary 14 and the transmission medium 34 at zone 66, the most likely outcome is that the first quantum system 26 is destroyed and no first verifying quantum system 62 arrives at the first receiver 50. This condition is identified as a possible compromise of the boundary 14 in the same fashion as a conventional laser tripwire system identifies such a breach. However, if the transmission medium 34 has been compromised by a sophisticated intercept/resend device, such as device 70 depicted in FIG. 1, a quantum system—namely verifying the first quantum system 62 may arrive at the first receiver 50.

Under normal circumstances at about the same time that the first receiver 50 receives the first verifying quantum system 62, the second receiver 58 receives a second verifying quantum system 74, which is the second quantum system 30. However, if the reliable path 54 is compromised, either no second verifying quantum system 74 is received by the second receiver 58 or, if the reliable path 54 has been compromised by a sophisticated intercept/resend device, a second verifying quantum system 74 may arrive at the second receiver 58. The system 10 is capable of detecting a compromise of either the transmission medium 34 or a compromise of the reliable path 54, but the system 10 is not capable of detecting a coordinated compromise of both the transmission medium 34 and the reliable path 54 that would include essentially a substitute system. Although such an attack is quite unlikely, the system 10 is typically configured so that the reliable path 54 is in a secured environment that is not vulnerable to compromise, and therefore there is negligible chance that the second verifying quantum system 74 is not the second quantum system 30.

The system 10 also includes an evaluation apparatus 78. The evaluation apparatus 78 assesses the first verifying quantum system 62 received by the first receiver 50 and assesses the second verifying quantum system 74 received by the second receiver 58. The evaluation apparatus 78 is typically a single apparatus in a single location (and preferably a secure location) that assesses the quantum properties of both the first verifying quantum system 62 and the second verifying quantum system 74. As previously indicated, in the embodiment of FIG. 1 the first quantum system 26 and the second quantum system 30 have a quantum mechanically entangled polarization property. The evaluation apparatus 78 assesses the visibility of the correlated polarization properties. Assessing the visibility of the polarization correlations typically requires a series of different measurements made on an ensemble of identical biphoton states. This visibility assessment is used to estimate whether the first verifying quantum system 62 and the second verifying quantum system 74 are quantum mechanically entangled in the entangled polarization property of the first quantum system 26 and the second quantum system 30.

The system 10 of FIG. 1 further includes an alarm system 82 that is used to indicate a possible compromise of the boundary 14 if the first verifying quantum system 62 and the second verifying quantum system 74 are not likely quantum mechanically entangled in the entangled polarization property of the first quantum system 26 and the second quantum system 30.

Figure 2:
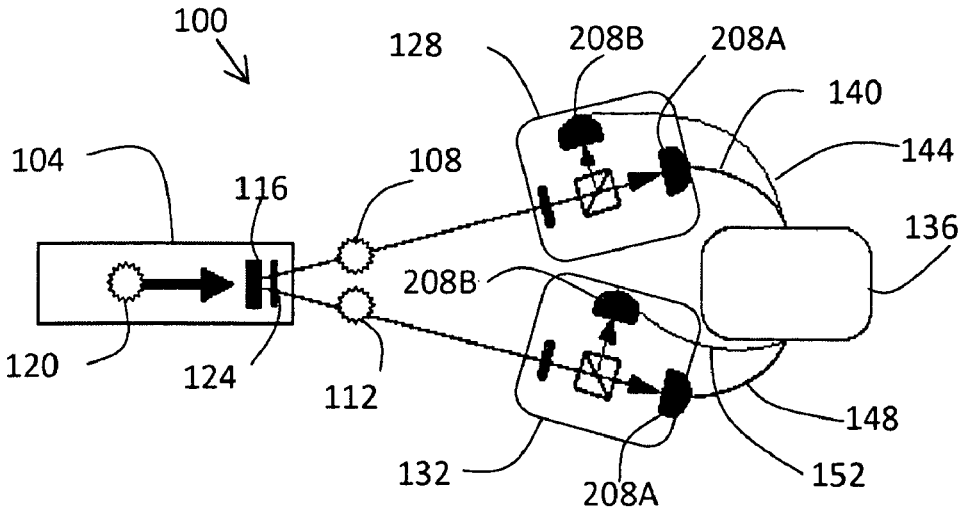
FIG. 2 is a somewhat schematic view of equipment for generating and comparing quantum mechanically entangled photons.

FIG. 2 illustrates various elements of a quantum mechanical entanglement system 100. The system 100 includes a source apparatus 104 for generating a "patrol" 108 and a "guard" 112 photons. The patrol 108 photon is analogous to the first quantum system 26 described with reference to FIG. 1, and the guard 112 photon is analogous to the second quantum system 30. The patrol photon 108 and the guard photon 112 are quantum mechanically entangled in at least one monitored physical property. The term "monitored physical property" indicates that the patrol 108 and the guard 112 photons may possess a multitude of entangled physical properties, but only one or some of them are monitored by the system 100. The source apparatus 104 is a polarization-entangled photon-pair source based on a type-II spontaneous parametric down conversion (SPDC) device. A nonlinear optical crystal 116, such as β-Barium Borate ($BaB_2O_4$, often abbreviated as "BBO"), mediates the spontaneous down conversion of a high-frequency (blue) pump photon 120 into a pair of lower frequency (red) photons, i.e., the patrol 108 and the guard 112 photons. A second, rotated BBO crystal 124 immediately follows the first crystal 116 to compensate for group velocity differences between the down-converted photons. Conservation of energy and momentum requires that the photons satisfy the equations $$\omega_{pump} = \omega_G + \omega_P \quad \text{(Eq'n 1)}$$

and $$k_{pump} = k_G^{\perp} + k_P^{\perp} \quad \text{(Eq'n 2)}$$

where $\omega_j$ and $k_j^{\perp}$ denote the longitudinal frequency and the transverse momentum of the $j^{th}$ photon, respectively.

The polarization-entangled state of a photon-pair generated by SPDC can be approximated by the Bell state $$|\varphi_{PG}\rangle \cong \frac{1}{\sqrt{2}}(|h_P, v_G\rangle + |v_P, h_G\rangle) \quad \text{(Eq'n 3)}$$

where the joint-polarization state $|h_P, v_G\rangle = |h_P\rangle \otimes |v_G\rangle$ is the direct product of single-photon horizontal and vertical polarization states $|h\rangle$ and $|v\rangle$, respectively, and the subscripts denote patrol (P) or guard (G) photons. This Bell state represents one of four maximally polarization-entangled biphoton states. The validity of this Bell state approximation is determined by the pulse power and the magnitude of the second-order susceptibility. Moreover, the polarization entanglement of this state can be expressed in terms of the experimentally measureable polarization-correlation visibility. (There is a one-to-one correspondence between the visibility and the von Neumann entropy of the state.) The visibility V quantifies the fringe contrast of the polarization-correlation spectrum obtained in either the h–v measurement basis or the conjugate diagonal-anti-diagonal (also referred to herein as +/–, 45/–45 and 45°/–45°) measurement basis. Here the diagonal (+) and anti-diagonal (–) basis states are defined as $|\pm\rangle = (|h\rangle \pm |v\rangle)/\sqrt{2}$.

FIG. 2 further depicts two receivers 128 and 132 (analogous to the first receiver 50 and the second receiver 58 described in conjunction with FIG. 1). Signals from the receivers 128 and 132 are received by an evaluation apparatus 136 (analogous to the evaluation apparatus 78 of FIG. 1) through communication links 140 and 144, 148, and 152. The signals conveyed through communication links 140, 144, 148, and 152 are electrical signals generated by single-photon detectors (SPDs) 208A and 208B. Single-photon detectors are not strictly required, but they are assumed herein to simplify the analysis. The SPDs 208A and 208B may be single-photon avalanche photodiodes that are commercially available. Each SPD emits an electrical signal when a photon is absorbed. The specific type of electrical signal may vary from vendor to vendor, but the electrical signal is usually transformed to an electronic logic signal, and electronics are provided to indicate a "coincident" detection within a specified time window. The duration of the time window depends upon the particular application requirements. If the duration of the time window is too short, the verification of reception of authentic entangled photon pairs may be missed because the time window did not permit the "simultaneous" detection of the paired photons. If the time window is too long a false "matching" photon may be received and mistakenly interpreted a paired photon. It is often beneficial to employ an electronic delay for one of the inputs (the input that represents the photon that travels the shortest distance to its SPD [208A or 208B]) in order to improve the ability to detect authentic photon pairs.

As an example of a coincidence detection unit, the evaluation apparatus 136 may include a coincidence logic unit having two input channels and one output channel. When two logic pulses are received as inputs within a specified time interval, the logic unit generates a logic pulse in the output. It is typical to monitor this collection process with a (digital) computer running commercially available data acquisition software.

Figure 3:
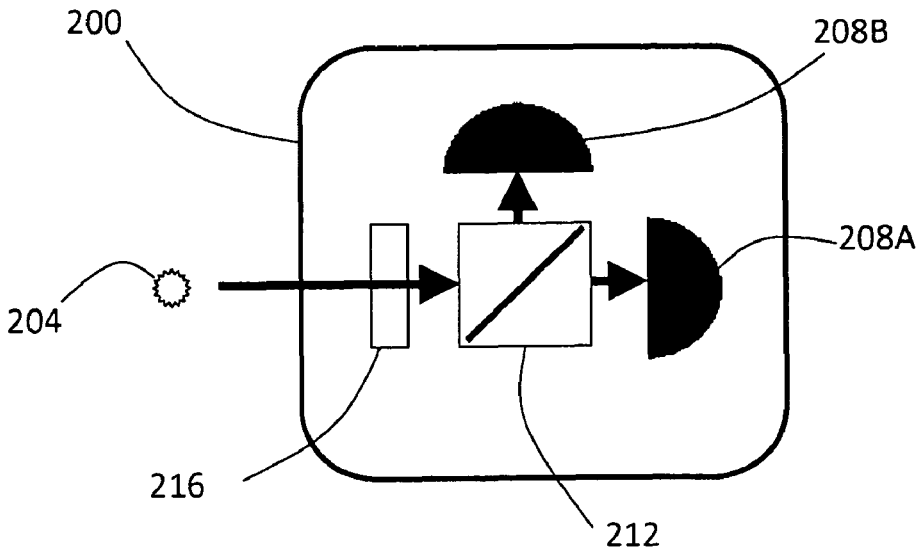
FIG. 3 is a somewhat schematic view of a device for assessing polarization entanglement.

FIG. 3 depicts further details of a receiver 200. The receiver 200 is used for sensing polarization correlation information between the patrol 108 and guard 112 photons. In FIG. 3 a photon 204 (representative of either a patrol 108 or a guard 112 photon) arrives at the receiver 200. When each entangled photon pair is generated each of the paired photons are entangled in all of the polarization characteristics, e.g., (a) h/v polarization with a value pair of [0°, 90°], (b) diagonal/anti-diagonal polarization with a value pair of [+45°, –45°], and (c) circular polarization with a value pair of [right, left]). In the embodiment of FIGS. 2 and 3, the selection of h/v polarization versus diagonal/anti-diagonal polarization for monitoring is made by the angular setting of a λ/2 wave plate 216 which is rotated about the transmission axis. Assuming that the λ/2 wave plate 216 is set for optimal h/v polarization detection (a setting that may be determined by trial adjustments of the rotation angle), h-polarized photons will pass through the λ/2 wave plate 216 and arrive at a polarizing beam splitter (PBS) 212 where they continue to the SPD 208A, whereas v-polarized photons will pass through the λ/2 wave plate 216 and be reflected to SBP 208B. Thus, if receiver 128 of FIG. 2 receives an h-polarized photon in SPD 208A at the same time (i.e., within the specified time window) as receiver 132 receives a v-polarized photon in its SPB 208B, it is likely that this represents identification of an authentic pair of h/v polarization entangled photons.

A sophisticated intruder might somehow determine that the system 100 was monitoring h/v polarized photons, and after compromising the transmission medium, employ an intercept-resend device in an attempt to inject h and/or v polarized photons into the patrol photon path. To counteract that threat it is helpful to frequently rotate the λ/2 wave plate 216 90° simultaneously in both the receivers 128 and 132 so that they are detecting a pseudo-random variation of h/v and diagonal/anti-diagonal polarized photons. In other words, the system may monitor coincidence rates for eight settings of the guard (G) and patrol (P) receivers: (G0, P0), (G0, P90), (G90, P0), (G90, P90), (G45, P45), (G45, P−45), (G−45, P45), and (G−45, P−45). Such a monitoring pattern would be difficult for an intruder to copy.

Also, polarization-entangled photon-pairs have the property of correlated circular polarizations. Polarization may be transformed from circular to linear with a quarter-wave (λ/4) plate. Thus, if a receiver is oriented to distinguish 0° and 90° linear polarization, then the addition of a half-wave plate converts the receiver so that it distinguishes 45° and −45° linear polarization (as previously discussed), and the addition of a quarter-wave plate converts the receiver so that it distinguishes right and left circular polarization. It is not necessary to install and remove the wave plates; they can all be left in the path. One set of wave plate orientations will transform 45/−45 to h/v; another set of orientations will transform right/left to h/v; and another set of orientations will leave the polarization property unchanged. In fact, there are an infinite number of polarization properties (45/−45, h/v, and right/left being three) and for each polarization property, there exists a combination of quarter wave plate and half wave plate orientations that will transform that state to linear.

It should be noted that several variations of receiver and SPD detectors may be employed. For example, a simpler (less expensive) system may be built using only one SPD in each receiver. That is, one receiver would have a 208A-type SPD and the other receiver would have a 208B-type SPD. The receiver with the 208A-type SPD would not require a polarizing beam splitter (PBS) 212. Another variation is to split the incoming receiver path at each receiver point in two directions—with one path going to an h/v polarization detection system and the other path going to a diagonal/anti-diagonal detection system. This configuration would not require any mechanical rotation of a λ/2 wave plate.

Returning to FIG. 2, the evaluation apparatus 136 accumulates a record of the coincident counts over a series of trials. Assuming the PBS 212 transmits horizontally polarized photons and reflects vertically polarized photons, the conditional probability for joint horizontal detection of the Bell state (Equation 3) at the patrol and guard receivers is $$R_C(\theta_P,\theta_G)=\sin^2(\theta_P+\theta_G) \quad \text{(Eq'n 4)}$$

where $\theta_P$ and $\theta_G$ are the corresponding analyzer angles. Measurements made in the conjugate +/− basis are obtained by rotating the incoming photons using a λ/2 wave plate. Moreover, those measurements yield a result similar to Eq. (4) apart from a π/2 phase shift. Hence, for the polarization-entangled state of Eq. (3), the empirical definition of the visibility as the contrast $$V=\frac{R_C^{max}-R_C^{min}}{R_C^{max}+R_C^{min}} \quad \text{(Eq'n 5)}$$

has a maximum of unity in either basis. In contrast, an unentangled state is predicted to have a visibility of zero in at least one basis, independent of whether the received state is a pure state, e.g., $|h_P, v_G\rangle$ or $|v_P, h_G\rangle$, or the classical mixture $$\rho_{PG}=\frac{1}{2}(|h_P, v_G\rangle\langle h_P, v_G|+|v_P, h_G\rangle\langle v_P, h_G|) \quad \text{(Eq'n 6)}$$

Thus, measuring the visibility provides an experimental means to quantify polarization entanglement and, therefore, differentiate between an ensemble of polarization-entangled states and the unentangled states prepared by a would-be intruder. (The term "intruder" refers to any malevolent entity attempting to defeat the integrity of a border.) An unentangled pure state implies the intruder chose the 'correct' measurement basis, while a mixed state implies the conjugate basis was used. For the unentangled states above, the visibility vanishes when measured in the +/− basis.

It is generally possible to quantify an appropriate sensitivity and specificity for a sensor to detect entanglements using the visibility characteristic of Equation 5 by incorporating additive Gaussian noise into the model system and using a binary decision evaluation that uses the measured visibility to discriminate between entangled and unentangled quantum states.

The binary decision evaluation is a formulation of (classical) detection theory for discriminating between two hypotheses based on an observed signal:

$$H_0{:}s_i=V_0+n \quad \text{(Eq'n 7A)}$$

and $$H_1{:}s_i=V_1+n \quad \text{(Eq'n 7B)}$$

In Equations 7A and 7B, $s_i$ represents the $i^{th}$ instance of the observed visibility and it is used to discriminate between the two hypotheses and $V_0=0$ and $V_1=1$ are the visibilities predicted for unentangled and entangled photon pairs, respectively, and n is a zero-mean Gaussian random noise variable of variance $\sigma^2$. Considering M measurements, the corresponding log-likelihood ratio test is:

$$\sum_i^M \tilde{s}_i \underset{H_0}{\overset{H_1}{\gtrless}} \frac{\ln\lambda}{d}+\frac{d}{2} \quad \text{(Eq'n 8)}$$

Where $\tilde{s}_i=s_i/\sigma M^{1/2}$ is the normalized sample data, λ defines the threshold for detection, and $$d=M^{1/2}(V_1-V_0)/\sigma \quad \text{(Eq'n 9)}$$

is the normalized displacement of the visibilities.

Discriminating between two known values in additive Gaussian noise leads to well-known results for the corresponding probability of detection $Q_d$ and false alarm probability $Q_0$:

$$Q_d=erfc(x_1) \quad \text{(Eq'n 10A)}$$

$$Q_0=erfc(x_0) \quad \text{(Eq'n 10B)}$$

Here the complimentary error function is defined as $$\mathrm{erfc}(y) \equiv (2\pi)^{-1/2} \int_y^{\infty} \exp[-x^2/2]dx \quad \text{(Eq'n 11)}$$

and the limits for $Q_0$ and $Q_d$, $$x_0=(\ln \lambda)/d+d/2 \quad \text{(Eq'n 12A)}$$

$$x_1=(\ln \lambda)/d-d/2 \quad \text{(Eq'n 12B)}$$

are expressed in terms of the threshold λ and the dimensionless displacement d. These results can be conveniently represented by a receiver operating characteristic (ROC) curve, which demonstrates the trade-off in detection sensitivity and detection specificity using a parametric plot of ($Q_0$, $Q_d$) with respect to the detection threshold λ.

Measurements of the visibility are useful for quantitatively discriminating between entangled and unentangled photon pair states. This detection scheme need not know a priori the types of quantum states prepared by the intruder, i.e., the detector works just as well for pure states as mixed states based on single-mode, polarization-entangled photon pairs. If an intruder attempts to measure and clone the polarization state of the patrol photon, the destruction of entanglement leads to a noticeable change in the measurement statistics recorded by the receivers.

A more difficult situation involves a case where the intruder has accurate knowledge about the transmission of the patrol photon, e.g., path, bandwidth, center frequency, timing information, etc. and the intruder, aware that the transmitted patrol photon is entangled with the secured guard photon, uses quantum teleportation to transfer the entangled state of patrol photon to a doppelganger photon.

Figure 4:
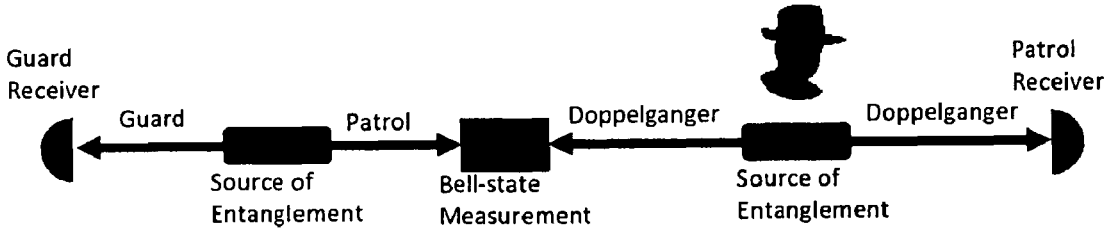
FIG. 4 is a schematic view of a quantum teleportation intrusion schema.

For the case of polarization-entangled photon pairs, the intruder may employ a pair of entangled doppelganger photons, as shown in FIG. 4. Then, by performing a Bell-state measurement on the patrol photon and the doppelganger photon, the intruder might be able to prepare an entangled state between the secured guard photon and the second, transmitted doppelganger photon. This form of teleportation, known as entanglement swapping, might be expected to preserve the entanglement generated by the source. However this scenario overlooks several considerations that may be used to undermine the viability of a quantum teleportation attack. The foremost concern is that when the Bell-state measurement succeeds, the guard and doppelganger photons are randomly projected into a state chosen from the set of four orthonormal Bell states. (Aside from its probabilistic outcome, there is no linear optical form of the BSM that succeeds deterministically.) As each of the sampled entangled states yields a distinct set of measurement outcomes, the visibility derived from measurements made on a series of these randomly prepared states would be zero.

It is possible for the intruder to locally correct the action of Bell-state measurement; however, doing so would require the intruder to delay the transmission of the second doppelganger photon until after the measurement of the patrol photon had occurred. When the patrolled perimeter is the shortest distance between two points (a straight line), then this delay in transmission is, in principle, always detectable by the receiver. On the other hand, if the patrol photon takes a less direct route, e.g., by patrolling a perimeter that turns or curves, then it is possible for the intruder to "cut corners" and "make up" time loss in implementing these corrective actions.

An adaptation of spectrally multimode, polarization-entangled photon pairs may be used to reject such measures. Briefly, the visibility of the received states before and after quantum teleportation may be examined while using an assumption that the intruder has applied the appropriate local unitary operation to complete the teleportation protocol and taking into account how polarization-correlation visibility behaves following teleportation with respect to the characteristics of the spectral modes and spectral entanglement.

The spectrally multimode analog of the polarization-entangled state presented in Equation 3 is $$|\varphi_{23}\rangle = \frac{1}{\sqrt{2}} \int d\omega \int d\omega' \begin{bmatrix} f(\omega, \omega')|h_P(\omega), v_G(\omega')\rangle + \\ g(\omega, \omega')|v_P(\omega), h_G(\omega')\rangle \end{bmatrix} \quad \text{(Eq'n 13)}$$

where f(ω,ω') and g(ω,ω') are normalized joint spectral amplitudes and $|h_P(\omega)\rangle=|h_P\rangle\otimes|\omega_P\rangle$ is a horizontally polarized patrol photon in the spectral eigenstate having frequency ω, etc. These states are typical of the polarization-entangled biphoton states prepared by SPDC when a pulsed pump pulse initiates the down-conversion process The specific forms of the joint spectral amplitudes in Equation 13 are strongly dependent on the type of SPDC, as well as the material properties of the nonlinear optical medium being used. Furthermore, the joint spectral amplitudes need not be identical or even individually separable with respect to frequency. The joint spectral amplitude is, however, generally decomposable as $$f(\omega, \omega') = \sum_{n=0}^{\infty} \lambda_n^{1/2} u_n(\omega) v_n(\omega') \quad \text{(Eq'n 14)}$$

where $\lambda_n$ is the $n^{th}$ Schmidt coefficient and the Schmidt modes $u_n$ and $v_n$ form a complete biorthonormal set for the joint spectral Hilbert space. (Normalization of f(ω,ω) implies $\Sigma_n\lambda_n=1$.) The joint amplitude g(ω, ω') is likewise represented by a Schmidt decomposition. For the case that Equation 14 has more than one term in the summation, then the joint spectral amplitude is said to be spectrally entangled, and this spectral entanglement can be quantified in terms of the Schmidt number K defined by $$K^{-1} = \sum_{n=0}^{\infty} \lambda_n^2 \quad \text{(Eq'n 15)}$$

The Schmidt number has a minimum of K=1 (an unentangled joint spectrum) and grows monotonically as the number of modes increases.

Analogous to the quantification of single spectral mode polarization entanglement, the polarization entanglement of a spectrally multimode state may be quantified in terms of the polarization-correlation visibility. An analysis of the polarization-correlation experiment shows that the theoretical maximum for the visibility is given by $$V=Re\int d\omega\int d\omega' f(\omega,\omega')g(\omega,\omega')^* \quad \text{(Eq'n 16)}$$

which is unity only when the joint spectral amplitudes are identical. Moreover, the maximal visibility is independent of the spectral entanglement.

Continuing with the analysis of quantum teleportation of a spectrally multimode, polarization-entangled biphoton state, assume that two pairs of photons are each prepared in a state of the general form of Equation 13, with the first state representing the patrol-guard (PG) pair and the second state representing the doppelganger (DD) pair. The patrol photon and one of the doppelganger photons are then subjected to a polarization-based Bell-state measurement, which is accomplished by interfering the two photons at a 50:50 beam splitter and analyzing each output mode, e.g., in the h–v basis. Conditioned upon the coincident detection of two photons, the resulting reduced, polarization density matrix of the guard and second doppelganger photons is $$\tilde{\rho}_{GD} = \frac{1}{2}(|h_G, v_D\rangle\langle h_G, v_D| + G|h_G, v_D\rangle\langle v_G, h_D| + G^*|v_G, h_D\rangle\langle h_D, v_G| + |v_G, h_D\rangle\langle v_G, h_D|) \quad \text{(Eq'n 17)}$$

where the off-diagonal coherence term $$G=\int d\omega\int d\omega'\int d\omega''\int d\omega''' f_{GP}(\omega,\omega''')g_{DD}(\omega''',\omega')^* g_{GP}(\omega,\omega'')^* f_{DD}(\omega'',\omega') \quad \text{(Eq'n 18)}$$

represents the overlap of the spectral amplitudes. The real component of G yields the visibility expected for the guard-doppelganger (GD) photon pair, i.e., $$V_{GD}=ReG \quad \text{(Eq'n 19)}$$

As noted in Equation 16, the initial patrol-guard state yields maximal visibility when the joint spectral amplitudes are identical. Assuming this relationship for both the PG and DD pairs, the Schmidt decomposition of Equation 14 is inserted into Equation 16 to find the resulting coherence. Simplifying the analysis to the case that the photons produce identical marginal spectra, gives the best possible visibility of the GD pair. Specifically, the visibility following teleportation is inversely proportional to the spectral entanglement carried by the joint spectral amplitude, i.e., $$V_{GD}^{max}=K^{-1} \quad \text{(Eq'n 20)}$$

In the absence of spectral entanglement, $\lambda_n=\delta_{n0}$, K=1, and the visibility of the swapped GD pair matches the unit visibility of the original pair (cf. Equation 16). However, in the limit of strong spectral entanglement, e.g., when $\lambda_n \approx 1/N$ and $K^{-1} \approx N$ (with N an effective number of spectral modes), the visibility of the GD pair can be much less than the original, expected visibility. Consequently, when the initial spectral entanglement between the patrol-guard photons is high, an intruder's attempts to use quantum teleportation can be detected based on the decrease in the observed visibility.

This last approach to verifying the authenticity of the polarization-entangled photon pair does not require any knowledge about discrepancies in the time of arrival of the patrol or doppelganger photons. Hence, even when the intruder has sufficient time to implement teleportation, the visibility it generates will be poor and, therefore, the intruder's presence will be detectable.

The terms "spectrally entangled" and "frequency entangled" are used interchangeably herein. A source apparatus for generating a pair of frequency entangled photons may be constructed as follows. A nonlinear optical crystal, e.g., BBO, is illuminated by a pump laser of a given spectral profile, e.g., a monochromatic or a broadband spectral profile. The pump laser enters the crystal at a direction that satisfies the second-order phase matching requirements for spontaneous parametric down conversion (the exact angle depending on the desired crystal and degree of frequency entanglement), whereupon passing through the crystal, photons comprising the pump laser undergo down conversion into a pair of lower frequency photons that serve as the outputted frequency entangled photons. Note that the conservation of energy restricts the frequencies of the outputted photon pair to sum to the energy of the incident pump laser photon.

A receiver for assessing spectral (frequency) entanglement of a photon may be constructed as follows. The frequency of each photon in the frequency entangled photon pair is measured individually. The individual measurements of frequency can be accomplished, e.g., using a diffraction grating to disperse each possible frequency toward a spatially separate photon detector. The photon detectors may be an array of single-photon detector or the pixels in a charged coupled device (CCD) planar array. By monitoring which frequencies are detected in coincidence events (when a photon is observed in each arm of the measurement apparatus), then the correlation between frequencies may be established. The degree of frequency entanglement may then be assessed from these measurements, e.g., by comparing the maximal and minimal widths of the associated two-dimensional frequency distribution.

The use of a pair of quantum systems that have a simultaneously entangled polarization characteristic and an entangled frequency characteristic of a first and second quantum system is particularly useful in thwarting a teleportation attack on a system for detecting compromise of a quantum mechanical transmission medium. A source for polarization and frequency entangled photons is a broadband analog of the source for polarization entangled photons. Whereas a "polarization entangled source" has heretofore referred to the polarization entangled photon pair generated in a cross ringed configuration and producing monochromatic output, a polarization and frequency entangled source refers to similarly produced pair of polarization entangled photons where the photons are not monochromatic, i.e., more than one frequency is populated. Hence, the descriptions for generating polarization entangled photons previously described herein are augmented slightly to note that the photons generated during SPDC are inherently spectrally multimode and that accurate accounting of the polarization and frequency properties identifies a pair of photons that are entangled in polarization and frequency. The degree to which the photons are entangled in these properties can be assessed using the receivers described as follows. When the photon pairs are simultaneously entangled in both polarization and frequency, the receivers for assessing such physical properties may be constructed in the same manner described herein for detecting frequency entanglement, supplemented by inclusion of a polarization analyzer (as shown in FIG. 3). Monitoring coincidence counts with respect to both the detected frequency and the corresponding polarization provides a methodology for assessing the entangled physical properties. As noted before, the degree of entanglement may be determined from these measurement results. Alternatively, the photon pair may be entangled in both frequency and polarization, but only one of those physical properties may be assessed by the measurement apparatus, e.g., when the polarization correlations are the relevant property to monitor, then frequency measurements may be ignored.

Figure 5:
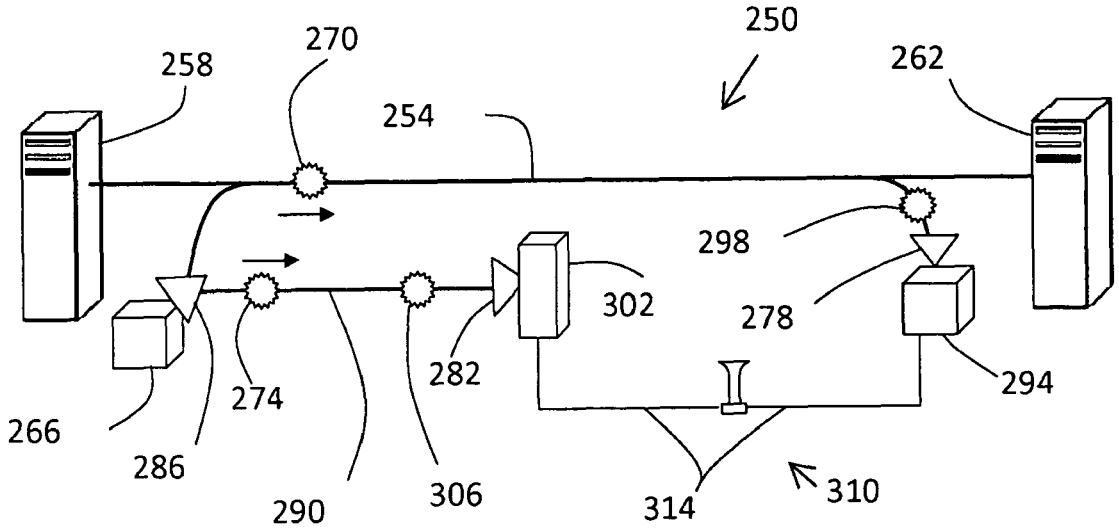
FIG. 5 is a somewhat schematic view of a system for monitoring the integrity of a communication link.

The various techniques described heretofore for detecting an intercept-resend attack on boundary monitoring system may be applied in other configurations for other purposes. For example, FIG. 5 illustrates a system 250 for monitoring the integrity of a communication link 254. The communication link 254 is exchanging information between a first communication system 258 and a second communication system 262. To monitor the integrity of the communication link 254, a source apparatus 266 is provided for generating a first 270 and a second 274 quantum system. The first quantum system 270 and the second quantum system 274 are quantum mechanically entangled in at least one monitored physical property. Each of the monitored physical properties has a value pair that corresponds to the first 270 and the second 274 quantum system. For example, if the first 270 and the second 274 quantum systems are polarization-entangled photon pairs, a monitored physical property may be their h/v polarization, in which case the value pair is (0°,90°). That is, if the h/v polarization of the first quantum system 270 is 0° then the h/v polarization of the second quantum system 274 is 90°. Similarly, if the first 270 and the second 274 quantum systems are polarization-entangled photon pairs, a monitored physical property may be their diagonal/anti-diagonal polarization, in which case the value pair is (+45°, −45°), and/or a monitored physical property may be the circular polarization of the first 270 and the second 274 quantum system, in which case the value pair is (right,left).

The system 250 further includes a first receiver 278 and a second receiver 282. There is a transmission apparatus 286 that is configured to direct the first quantum system 270 through the communication link 254 to the first receiver 278 and configured to direct the second quantum system 274 through a reliable path 290 to the second receiver 282.

There is a first evaluation apparatus 294 that evaluates a first value of each monitored physical property of a first verifying quantum system 298 received by the first receiver 278. There is a second evaluation apparatus 302 that evaluates a second value of each monitored physical property of a second verifying quantum system 306 received by the second receiver 282. Typically the reliable path 290 is a secure link so that the second verifying quantum system 306 is the second quantum system 274.

There is an alarm system 310 that indicates a possible compromise of the communication link 254 if the estimated first value of each monitored physical property of the first verifying quantum system 298 and the estimated second value of each monitored physical property of the second verifying quantum system 306 are not likely equal to the paired value of each monitored physical property. In the embodiment of FIG. 5 the alarm system 310 is in communication with the first evaluation apparatus 294 and the second evaluation apparatus 302 through a separate communication channel 314. In other embodiments the alarm system 310 may be in communication with the first evaluation apparatus 294 and the second evaluation apparatus 302 through the communication link 254.

Figure 6:
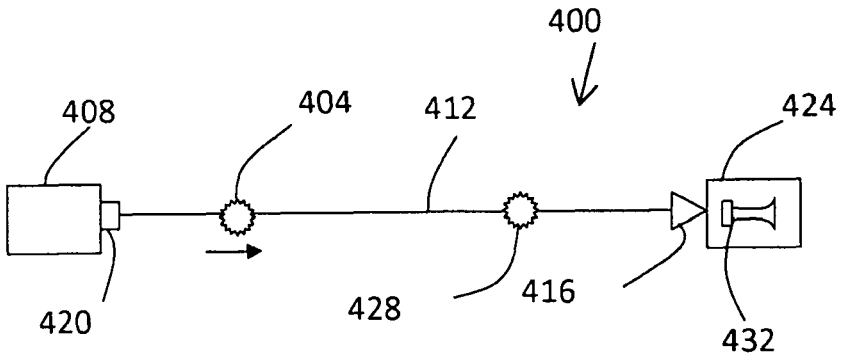
FIG. 6 is a somewhat schematic view of a system for monitoring the integrity of a transmission of a quantum system.

FIG. 6 depicts an embodiment of a system 400 for monitoring the integrity of a transmission of a quantum system 404. In the embodiment of FIG. 6 the quantum system 404 is a photon. The system 400 includes an apparatus 408 for generating the quantum system 404 with an as-transmitted value of a monitored physical property. In the embodiment of FIG. 6 the apparatus 408 includes a single photon source and a device that transforms the single photon to have a selected as-transmitted value of the monitored physical property. For example, the single photon source may emit polarized photons and a half-wave plate disposed in the path of the photons may be used to establish an as-transmitted value of 90° polarization for the emitted photons. In some embodiments the apparatus 408 may include a source apparatus for generating a first and a second quantum system, the first and the second quantum systems being (for example) polarization entangled, and one of the quantum systems is used as the quantum system 404 of FIG. 6 and the other quantum system is discarded.

The system 400 of FIG. 6 further includes a transmission medium 412, a receiver 416 and a transmission apparatus 420 that is configured to direct the quantum system 404 through the transmission medium 412 to the receiver 416. The transmission apparatus 420 is typically an optical coupling device that provides an interface between the apparatus 408 and the transmission medium 412. The receiver 416 is typically a receiver similar to receiver 128 or 132 depicted in FIG. 2 or receiver 200 depicted in FIG. 3.

There is an evaluation system 424 that estimates an as-received value of the monitored physical property of a verifying quantum system 428 received by the receiver 416. There is an alarm system 432 that compares the as-transmitted value of the monitored physical property of the transmitted quantum system 404 with the as-received value of the monitored physical property of the verifying quantum system 428, and indicates a possible compromise of the transmission of the quantum system if the estimated as-received value of the monitored physical property of the verifying quantum system 428 does not likely correspond to the as-transmitted value of the monitored physical property of the transmitted quantum system 404. Various mechanisms may be used to ensure that the alarm system 432 knows the as-transmitted value of the monitored physical property of the transmitted quantum system 404. For example, the as-transmitted value of the monitored physical property of the transmitted quantum system 404 may be communicated over a secure communication link to the alarm system 432 by the apparatus 408 that generated the quantum system 404. Alternately, a pattern of as-transmitted values of the monitored physical property of a series transmitted quantum systems 404 may be known and monitored by the alarm system 432.

The system 400 of FIG. 6 may be used in various applications including monitoring the integrity of a boundary and monitoring the integrity of a communication link.

Example

A polarization-entangled "quantum fence" may be constructed using current quantum optical technology. In particular, SPDC-based entanglement sources are readily available for generating pulsed polarization-entangled photon pairs at rates up to 250,000/pairs/sec/mW of pump power. In addition, measurement of the polarization-correlation visibility in conjugate bases can be performed using an entirely passive experimental apparatus, i.e., on-the-fly reconfiguration is unnecessary. Moreover, both free-space and fiber-based sensors are candidates for such application.

As a first demonstration of these principles, a free-space quantum fence was constructed using a polarization-entanglement source. The purpose of the demonstration was to "simulate" the behavior of a quantum fence system. The experimental setup had only one detector per receiver, so the system was simply cycled through all of the settings to generate data for all eight pairs of polarizations (G0, P0), (G0, P90), (G90, P0), (G90, P90), (G45, P45), (G45, P−45), (G−45, P45), and (G−45, P−45). The data sets consisted of lists of numbers corresponding to the number of coincidences recorded in one-second intervals. In effect, all the data were collected for one of the eight settings, then all of the data for the next setting, and so on. In a real system, one would switch between settings much more rapidly in order to make things difficult for an intruder. To simulate the intruder, coincidences were detected between uncorrelated photons. This was done by simply changing the electronic delay previously-mentioned herein so that coincidences were recorded only for photons originating from different down-conversion events. In practice, this gives a much lower coincidence rate, so the collection window was adjusted to give comparable overall count rates.

In this specific demonstration, an Argon laser operating at 351.1 nm pumped a 1-mm Beta Barium Borate (BBO) crystal with the crystal axis oriented for degenerate type-II SPDC at 702 nm. Horizontally and vertically polarized photons were emitted into different directions under the constraint of conservation of energy and momentum. By adjusting the orientation of the BBO crystal, the two emission patterns can be made to intersect. In this cross-ring configuration, one photon was emitted into each of the two spatial paths defined by intersecting emission cones. A second, rotated BBO crystal immediately followed the first to compensate for group velocity differences between the down-converted photons. Each photon then traveled ~60 cm to a polarization analyzer, which consisted of rotated $\lambda/2$ wave plates, polarizing beam splitters, and single-photon detectors with the measurement basis for each analyzer station chosen by the orientation of an inserted wave plate, cf. FIG. 2.

Figure 7:
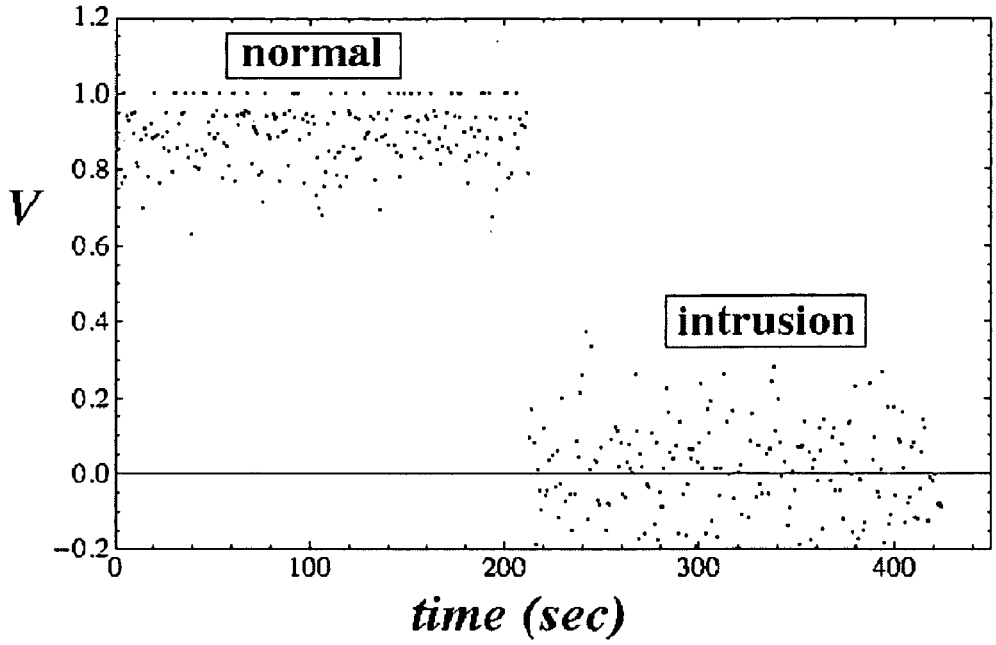
FIG. 7 is a plot of visibility measurements made for both entangled and unentangled photon pairs.

FIG. 7 presents a time series of visibility measurements made in the +/− basis for both entangled and unentangled photon pairs. Each time-point corresponds to a 1-s collection window for measuring the maximum and minimum coincident counts of Equation 5. Subtraction of the relatively high dark count rate leads to some artifacts in the data, i.e., 'normal' visibilities of 1.0 and 'intrusion' visibilities less than 0.

The test monitored coincidence counts over a 1-second window and yielded maximal count rates of 188 pairs/sec and 35 pairs/sec in the h−v and the +/− bases, respectively. The lower count rate in the +/− basis was due to the use of a single-mode fiber in front of one SPD. The visibility was calculated by recording coincidence counts in the orientations expected to provide maxima and minima for both the h−v and the diagonal-anti-diagonal bases; the average corrected visibility in each basis was 0.9755±0.0169 (h−v) and 0.9139±0.0834 (+/−), respectively. Visibilities presented in FIG. 7 were obtained by subtracting the average dark count rate of the detector(s) from the raw count rate. While much higher visibilities might be achievable, the present results are entirely sufficient.

Visibility measurements for unentangled photons were also performed. In this experiment, 1-second windows of stray photons were collected at each detector to simulate a maximally mixed state. A maximal rate of 7.7 pairs/sec was detected with an average visibility −0.01±0.160, which is consistent with the theoretical prediction of zero. The small negative contribution is an artifact of using the same analyzer orientations as in the entangled photon case; the maximum and minimum in the polarization correlation of the stray room light were probably at slightly different angles.

The ability of the quantum fence to sense an intruder's presence was tested by combining the visibilities acquired for entangled and unentangled light into the time series shown in FIG. 7. The visibility in the diagonal-anti-diagonal basis was plotted as a function of sample number with the first 213 points representing entangled pairs and the last 200 points representing unentangled light.

Taking the average visibility in the normal region as a baseline, the dimensionless displacement d was calculated with respect to the visibility observed in the transition or intrusion regions. Assuming a decision based on a standard deviation of $\sigma=0.1$, the average dimensionless displacement in the intrusion region was $d\approx7.3$ for a value $\langle V_0\rangle=0.16$ (one $\sigma$ away from the mean). The corresponding receiver operating characteristic (ROC) curve is shown in FIG. 8.

Figure 8:
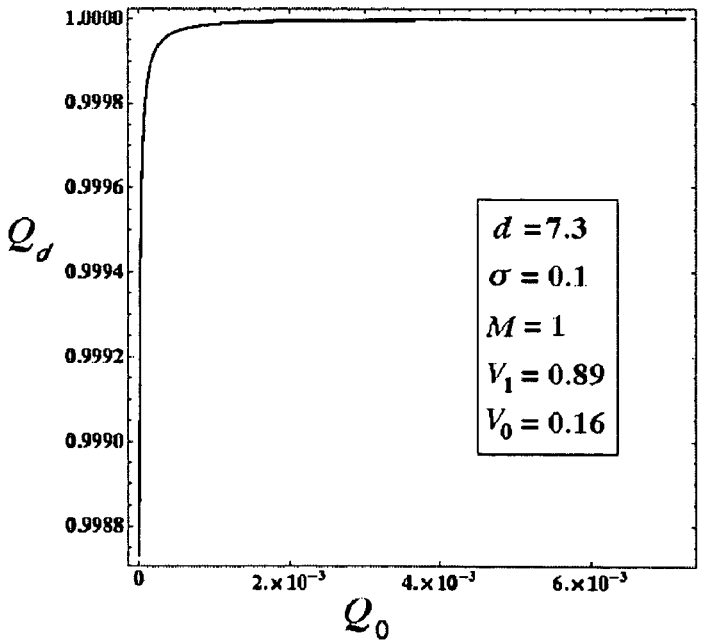
FIG. 8 is an experimentally derived receiver operating characteristic curve for a system for monitoring the integrity of a boundary.

FIG. 8 depicts an experimentally derived ROC curve for the polarization-entangled quantum fence: the probability for intrusion detection $Q_d$ and the corresponding false alarm rate $Q_0$ are plotted for values of the dimensionless distance d=7.3 and the standard deviation $\sigma=0.1$ assuming a single measurement M=1. For reference, note that for [0073][0001] a threshold value of $\lambda=1$ the experiment yields $Q_d\cong0.9999$ and $Q_0\cong1.311\times10^{-4}$.

The results obtained from the experimental setup, which transmitted each photon 0.6 m, may be used to extrapolate the sensor's performance across longer distances. Specifically, atmospheric attenuation may be accounted for in the model of the patrol photon transmitted across a distance L. (This adjustment accounts for the reduction in count rate due to attenuation, neglecting losses in the coincidence counts due to decoherence.) At a wavelength of 800 nm, the effects of atmospheric attenuation can be as low as 0.2 dB/km under best weather conditions and as high as 20 dB/km in the presence of heavy mist. (The actual test system generated photon pairs at 702 nm, but this wavelength may be tuned by changing the pump pulse wavelength and the properties of the nonlinear optical crystal.)

Figure 9:
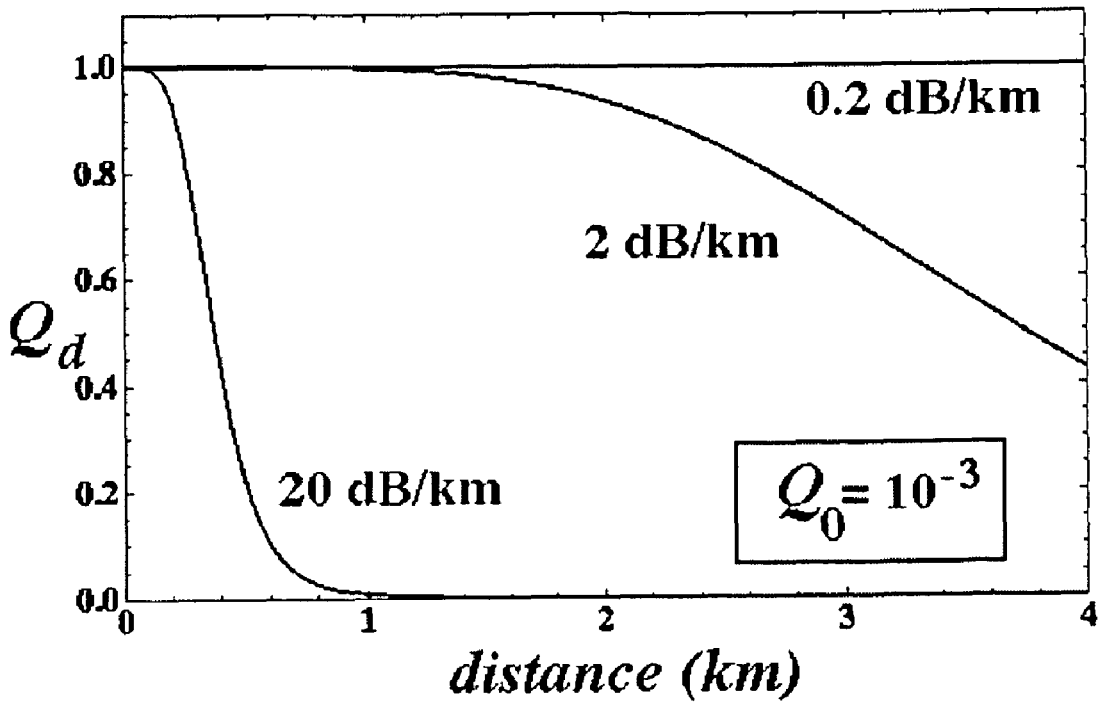
FIG. 9 is a plot of detection probabilities over distance for three attenuation factors.

FIG. 9 depicts the detection probability as a function of transmission distance and atmospheric attenuation. The curves are labeled by the value of the attenuation factor and $Q_d$ is calculated for the fixed false alarm rate of $Q_0=10^{-3}$. Assuming the measurement error scales as $(\text{count rate})^{-1/2}$, the standard deviation may be expressed in terms of the transmission distance L and the atmospheric attenuation using the initial condition $\sigma=0.0788$ at L=0.6 m. For the case of 0.2 dB/km loss, a high probability of detection (above 0.9999) is maintained across 3 km. For an attenuation of 20 dB/km, the transmission range for detection probability above 0.999 is approximately 120 m.

Results of this test demonstrate that visibility measurements provide a viable means of authenticating the entanglement of a photon pair. Even with a modest experimental setup, a polarization-entangled quantum fence senses intrusions with a high probability of detection and a low false-alarm rate over a long range of transmission distances. A quantum fence using brighter, pulsed sources of polarization-entangled photon pairs, with count rates reported as high as 250,000 pairs/sec, could yield similar performance characteristics while requiring a collection window as short as 1 ms.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A system for monitoring the integrity of a boundary comprising:

a source apparatus for generating a first and a second quantum system, the first and the second quantum systems being quantum mechanically entangled in at least one monitored physical property;

a transmission medium disposed adjacent the boundary;

a first receiver and a second receiver;

a transmission apparatus for directing the first quantum system through the transmission medium to the first receiver and for directing the second quantum system to the second receiver;

an evaluation apparatus for assessing a first verifying quantum system received by the first receiver and for assessing a second verifying quantum system received by the second receiver and for estimating whether the first verifying quantum system and the second verifying quantum system are quantum mechanically entangled in the at least one monitored physical property; and an alarm apparatus for indicating a possible compromise of the boundary if the first verifying quantum system and the second verifying quantum system are not likely quantum mechanically entangled in the at least one monitored physical property.

2. The system of claim 1 wherein the source apparatus comprises a spontaneous parametric down conversion photon pair generator and the first and the second quantum system comprise a pair of quantum mechanically entangled photons.

3. The system of claim 1 wherein the at least one monitored physical property comprises an entangled polarization characteristic of the first and the second quantum systems.

4. The system of claim 1 wherein the at least one monitored physical property comprises an entangled frequency characteristic of the first and second quantum systems.

5. The system of claim 1 wherein the at least one monitored physical property comprises an entangled polarization characteristic and an entangled frequency characteristic of the first and the second quantum systems.

6. The system of claim 1 wherein the transmission medium comprises the atmosphere.

7. The system of claim 1 wherein the transmission medium comprises a fiber optic cable.

8. A system for monitoring the integrity of a communication link comprising:

a source apparatus for generating a first and a second quantum system, the first and the second quantum systems being quantum mechanically entangled in at least one monitored physical property, with each monitored physical property having a value pair corresponding to the first and the second quantum system;

a first receiver and a second receiver;

a transmission apparatus for directing the first quantum system through the communication link to the first receiver and for directing the second quantum system to the second receiver;

a first evaluation apparatus for estimating a first value of each monitored physical property of a first verifying quantum system received by the first receiver;

a second evaluation apparatus for estimating a second value of each monitored physical property of a second verifying quantum system received by the second receiver; and an alarm system for indicating a possible compromise of the communication link if the estimated first value of each monitored physical property of the first verifying quantum system and the estimated second value of each monitored physical property of the second verifying quantum system are not likely equal to the paired values of each monitored physical property.

9. The system of claim 8 wherein the source apparatus comprises a spontaneous parametric down conversion photon pair generator and the first and the second quantum system comprises a pair of photons.

10. The system of claim 8 wherein the first and the second quantum system comprise a polarization-entangled photon pair and the at least one monitored physical property and value pair comprises a monitored physical property with a value pair selected from the group consisting of (a) h/v polarization with a value pair of)(0°,90°, (b) diagonal/anti-diagonal polarization with a value pair of) (+45°,−45°, and (c) circular polarization with a value pair of (right,left).

11. The system of claim 8 wherein the at least one monitored physical property comprises an entangled frequency characteristic of the first and second quantum systems.

12. The system of claim 8 wherein the at least one monitored physical property comprises an entangled polarization characteristic and an entangled frequency characteristic of the first and second quantum systems.

13. The system of claim 8 wherein the transmission medium comprises the atmosphere.

14. The system of claim 8 wherein the transmission medium comprises a fiber optic cable.

15. A system for monitoring the integrity of a transmission of a quantum system comprising:

an apparatus for generating the quantum system with an as-transmitted value of a monitored physical property;

a transmission medium;

a receiver;

a transmission apparatus for directing the quantum system through the transmission medium to the receiver;

an evaluation system for estimating an as-received value of the monitored physical property of a verifying quantum system received by the receiver; and an alarm system for comparing the as-transmitted value of the monitored physical property of the transmitted quantum system with the as-received value of the monitored physical property of the verifying quantum system and for indicating a possible compromise of the transmission of the quantum system if the estimated as-received value of the monitored physical property of the verifying quantum system does not likely correspond to the as-transmitted value of the monitored physical property of the transmitted quantum system.

16. The system of claim 15 wherein the monitored physical property comprises a polarization characteristic of the quantum system.

17. The system of claim 15 wherein the transmission medium comprises the atmosphere.

18. The system of claim 15 wherein the transmission medium comprises a fiber optic cable.

19. A method for monitoring the integrity of a boundary comprising:

generating a first and a second quantum system, the first and the second quantum systems being quantum mechanically entangled in at least one monitored physical property;

transmitting the first quantum system through a transmission medium along the boundary to a first receiver and transmitting the second quantum system to a second receiver;

estimating whether the first verifying quantum system received by the first receiver and the second verifying quantum system received by the second receiver are quantum mechanically entangled in the at least one monitored physical property; and generating an indication of possible compromise of the boundary if the first verifying quantum system and the second verifying quantum system are not likely quantum mechanically entangled in the at least one monitored physical property.

20. A method for monitoring the integrity of a communication link comprising:

generating a first and a second quantum system, the first and the second quantum systems being quantum mechanically entangled in at least one monitored physical property, with each monitored physical property having a value pair corresponding to the first and the second quantum system;

transmitting the first quantum system through the communication link to a first receiver and transmitting the second quantum system to a second receiver;

estimating a first value of each monitored physical property of a first verifying quantum system received by the first receiver;

estimating a second value of each monitored physical property of a second verifying quantum system received by the second receiver;

comparing the estimated first value of each monitored physical property of the first verifying quantum system with the estimated second value of each monitored physical property of the second verifying quantum system; and generating an indication of a possible compromise of the communication link if the estimated first value of each monitored physical property of the first verifying quantum system and the estimated second value of each monitored physical property of the second verifying quantum system are not likely equal to the value pair of each monitored physical property.

21. A method for monitoring the integrity of a transmission of a quantum system comprising:

generating the quantum system with an as-transmitted value of a monitored physical property;

transmitting the quantum system through a transmission medium to a receiver;

estimating an as-received value of the monitored physical property of a verifying quantum system received by the receiver;

comparing the as-transmitted value of the monitored physical property of the transmitted quantum system with the estimated as-received value of the monitored physical property of the verifying quantum system; and indicating a possible compromise of the transmission of the quantum system if the estimated as-received value of the monitored physical property of the verifying quantum system does not likely correspond to the as-transmitted value of the monitored physical property of the transmitted quantum system.

* * * * *